United States Patent [19]

Block

[11] 4,207,177

[45] Jun. 10, 1980

[54] MATERIAL SORTER

[76] Inventor: Philip M. Block, 58 Fleetwood Rd., Newington, Conn. 06111

[21] Appl. No.: 892,973

[22] Filed: Apr. 3, 1978

[51] Int. Cl.[2] ..... B07C 5/00

[52] U.S. Cl. ..... 209/44.2; 209/930; 209/644; 209/152

[58] Field of Search ..... 209/629, 930, 473, 644, 209/44.2, 44.3, 152, 473, 482

[56] References Cited

U.S. PATENT DOCUMENTS

| | | | |
|---|---|---|---|
| 3,790,091 | 2/1974 | Law | 241/24 |
| 3,957,630 | 5/1976 | Mooradian | 209/152 |
| 4,018,675 | 4/1977 | Petrucci | 209/644 |

*Primary Examiner*—Allen N. Knowles

[57] ABSTRACT

A material sorter to sort materials having various weight and aerodynamic characteristics such as, for example, relatively heavy magazines and corrugated cardboard from relatively lightweight newspaper. The sorter comprises a generally elongated hollow member having openings at oppositely disposed ends, the member preferably being a hollow cylindrically shaped tube. The axis of the tube is inclined with respect to the ground and the tube is rotated mechanically. The sorter also includes a source of forced air provided by a fan positioned at the lower opening of the tube, the fan is inclined at a variable angle with respect to the axis of the cylinder and provides a continuous spiral-patterned stream of air flowing upwardly through the cylinder. In the operaton of the material sorter, mixed paper having various weight and aerodynamic characteristics is placed in the upper opening of the tube. As the paper falls downwardly through the tube and is tumbled by the rotation of the tube, it separates. The lighter weight paper is carried upwardly by the air stream and out the upper opening of the tube and the heavier paper falls through the lower opening of the tube.

2 Claims, 2 Drawing Figures

MATERIAL SORTER

BACKGROUND OF THE INVENTION (l) Field of the Invention

The present invention relates to an apparatus for and a method of separating materials of various weight and aerodynamic characteristics. More particularly, the present invention relates to an apparatus for and a method of separating relatively light density weight and high surface area paper such as newspaper from relatively heavy paper such as magazines and corrugated cardboard.

(2) Description of the Prior Art

In view of the shortages of timber for paper manufacture and the expense of making paper from raw timber, it has been found desirable to recycle or reuse various types of papers. However, in order to recycle paper, it is necessary to separate the papers into their homogeneous types. In the paper recycling industry, it has been the practice to sort papers by hand. For example, it is necessary to hand sort paper into the following catagories: newspapers, magazines, corrugated cardboard and rubbish. Hand sorting is a time consuming and relatively expensive task. Thus, prior art methods allow sorting of paper only on a relatively small scale and at an extremely low rate of separation. It should be appreciated that the arduous and time consuming task of sorting paper by hand is the economic bottleneck which has prevented widespread use of recovered paper.

Thus, it is a principal object of the present invention to provide an apparatus for and a method of accomplishing the heretofore difficult task of sorting papers into types having varying weight and aerodynamic characteristics.

SUMMARY OF THE INVENTION

The present invention provides an apparatus and method which allows for the separation of papers having various weights and aerodynamics. A particularly novel aspect of the present invention is that it not only utilizes the varying weight characteristics of the papers to be sorted, but also utilizes the varying aerodynamic characteristics of the papers to be sorted. In the present invention, there is provided an elongated hollow member open at oppositely disposed ends. Preferably, the member is a hollow cylindrical tube. The hollow member is inclined at a variable angle with respect to the ground and a stream of air is forced upwardly through the bottom opening of the elongated member out the top opening of the member. During the sorting of the paper, the apparatus is also provided with a means of rotating the elongated member. In the case of a hollow cylindrical tube, it is preferable to provide rotation with a series of rollers, at least one of which is driven by a mechanical means. The interior surface of the cylindrical tube has extending therefrom a large number of protrusions such as spikes. The protrusions are preferably spaced apart and patterned helically along the interior surface of the tube in a manner to retain larger pieces of paper and to allow passage of smaller pieces therebetween. In the method of sorting the paper, paper of varying weights, for example, newspaper and bound magazines are introduced into the upper opening of the elongated member. As the elongated member is rotated, the bundles of paper are separated as they tumble downwardly through the tube. The air which is forced upwardly through the elongated member and which is preferably delivered to the tube at an angle to the axis of rotation thereof, forces the newspaper which has generally a lighter weight and a larger surface area than the magazines, upwardly through the elongated member and out the upper opening. Because the aerodynamic force on the heavier and smaller surface area paper such as bound magazines is not as strong as that on the lighter paper, such as newspaper, the heavier papers such as magazines continue to tumble downwardly along the elongated member and eventually fall out the lower opening of the elongated member.

DETAILED DESCRIPTION OF THE INVENTION

Figure 1:
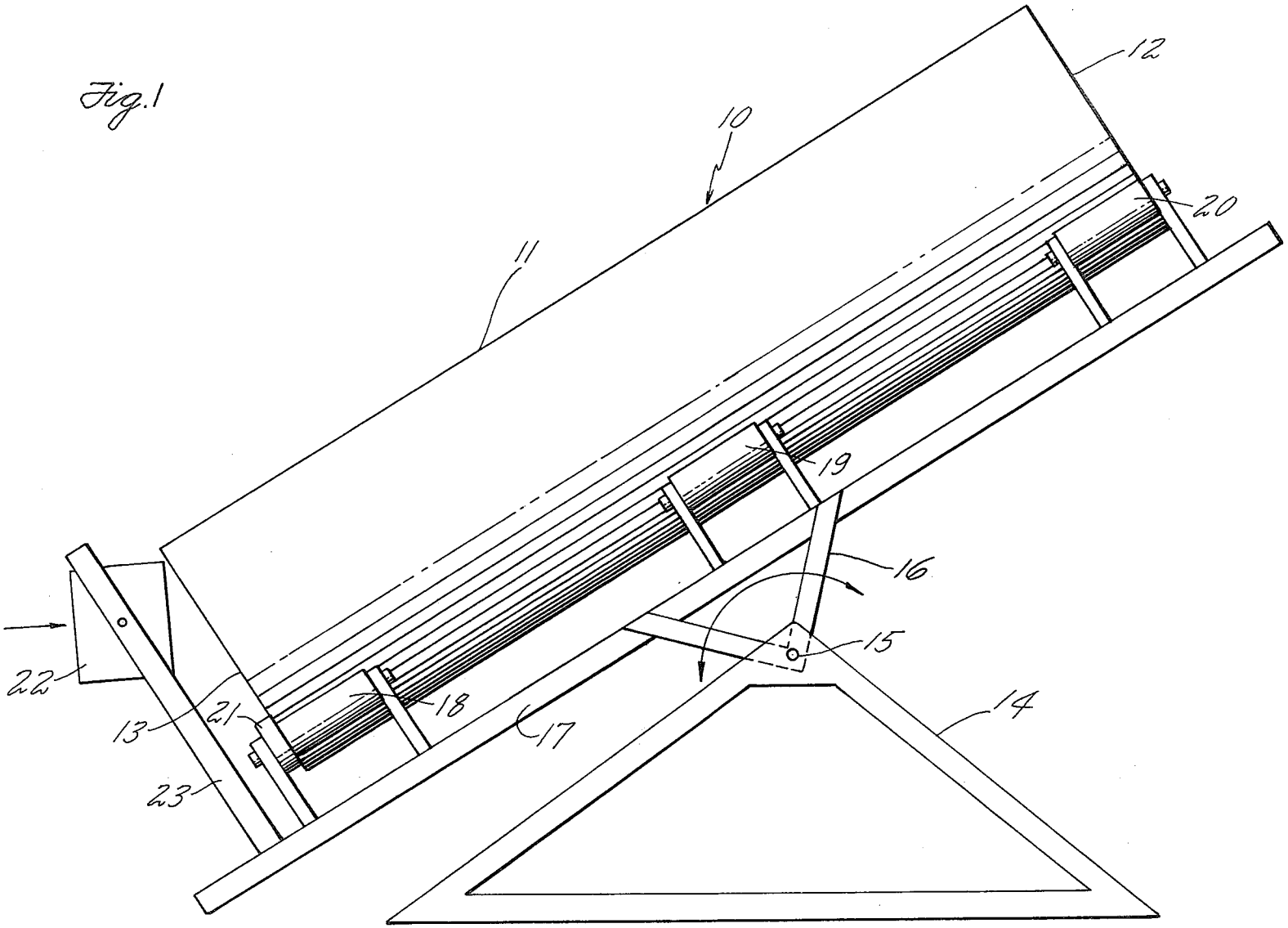
FIG. 1 shows a side view of the apparatus of the present invention.

Referring to FIG. 1, the sorting apparatus is shown generally at reference character 10. Sorting apparatus 10 comprises a hollow elongated member 11 which is preferably in the shape of a hollow cylindrical tube. However, it should be understood that other shapes can be used such as a frustoconical tube or a tube having an assymetrically or irregularly shaped cross section such as a square, hexagon and the like. Elongated tube 11 is inclined at a variable angle of between 0 and 90 degrees with respect to the horizontal and includes an upper opening 12 and a lower opening 13, the function of which will be described hereinafter. Elongated tube 11 is supported on a base 14 which can have any conventional shape or structure so long as it is capable of supporting the apparatus. Base 14 includes pivot bar 15 which is connected to a support bar 16. Support bar 16 is rigidly attached to frame 17. Pivot 15 allows for rotation of frame 17 with respect to base 14. A plurality of support rollers 18, 19 and 20 are positioned on frame 17 and provide a means for rotating tube 11. It should be understood that the rollers 18, 19 and 20 can be replaced by any mechanical means which supports tube 11 but which provides for rotation of tube 11. Preferably, roller 18 includes a cylindrical projection 21 on the bottom thereof which acts as a stop for the end of cylindrical tube 11. Other stop means may be employed.

A fan 22, which is supported from frame 17 by a stand 23, forces air through opening 13 into tube 11 and out of opening 12. Preferably, the forced air is directed into the tube at an angle variable relative to the axis of tube 11 so as to impinge the interior bottom wall of the tube 11. It should be understood that the fan is provided with a variable speed control which allows control of the mass flow and velocity of the air stream within the cylindrical tube 11.

Figure 2:
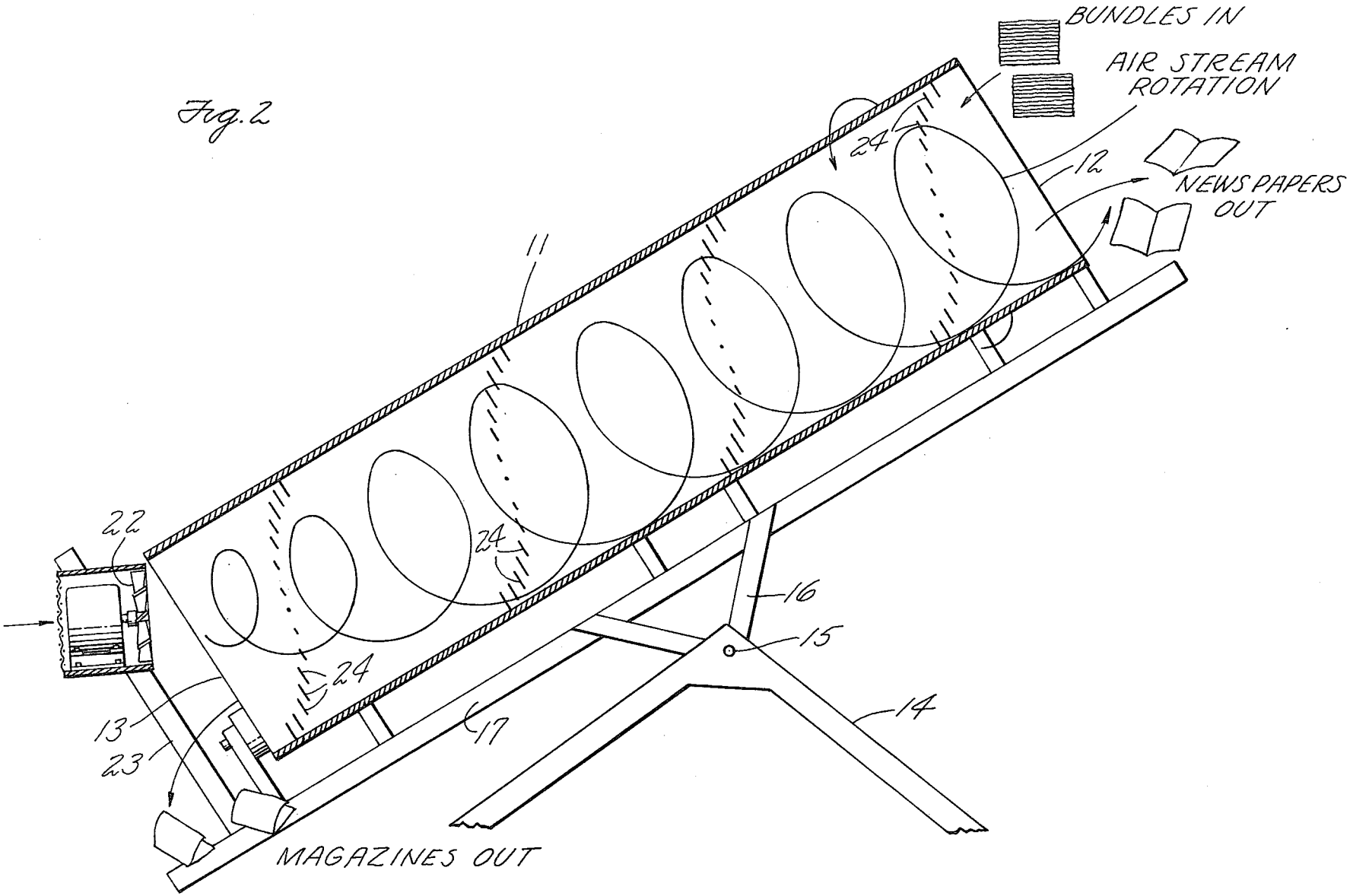
FIG. 2 shows a sectional side view of the hollow cylindrical tube shown in FIG. 1.

As best shown in FIG. 2, the interior of tube 11 is provided with a series of protrusions 24, such as, for example, metal spikes which project from the interior surface of the tube. Protrusions 24 are positioned on the interior of the tube 11 in a helical pattern. The vertical length, slope with respect to the axis of the tube, shape and spacing of the protrusions can be designed according to the paper to be sorted. The protrusions 24 provide for movement of the paper downwardly through the tube at a constant mass flow rate. The protrusions also function to lift the bundles of paper which have not been separated up along the interior wall of the cylinder 11 so that the paper freefalls downwardly toward the bottom of the tube. As the bundles of paper fall toward the bottom of the tube, they tend to separate. At this point the newspapers are still randomly mixed with the heavier papers, such as magazines, but, now, the bundled newspapers and the heavier papers are spaced apart to allow for sorting of the newspapers from the heavier paper by the forced air.

The stream of air, which is produced by fan 22, functions to provide a strong aerodynamic force on the papers such as newspaper having a relatively light weight and a generally large surface area. The air flow blows the newspapers upwardly through the tube and eventually out of the open end of the tube. The air flow does not have such an aerodynamic effect on the heavier papers having less surface area. Thus, these papers continue the cycle downwardly through the tube 11 until they are expelled at the bottom opening. Thus, the relatively light weight and high surface area papers are sorted from the generally heavy and low surface area papers. Also, refuse which is generally heavy and which generally has a small surface area is also expelled out of the bottom of the tube.

In the present invention, the particularly preferred source of forced air is an air stream provided by a conventional fan of the type having bevelled blades. As best shown in FIG. 2, the fan provides an air flow which is spiral and which corresponds to the helical pattern of protrusions 24. The spiral patterned air flow functions to push the paper upwards away from protrusions 24 and scour the interior walls of the tube 11 as the paper is tumbled. However, it should be understood that many other sources of forced air can be used in the practice of the present invention.

Although it is preferred that tube 11 have a smooth interior surface that has spikes extending therefrom in a helical pattern, it should be understood that other types of projections or obstructions may be included on the interior surface of tube 11. For example, the tube can be formed of sheet metal having a helically grooved interior. Although it is preferred that the pattern of the projections be helical, other patterns may be used. For example, the spikes could be arranged in spaced-apart circular patterns or in parallel lines to the axis.

The tube 11 has a relatively large diameter and has considerable length. It is envisioned that the tube will have a length of about 20–50 feet and a diameter of approximately 8–15 feet and a length to diameter ratio of about 1:3. However, it should be understood that the length to diameter ratio should be varied with respect to the type of paper which is to be sorted.

The mixed papers, that is bundles of papers, including the various types of paper, can be placed in the upper opening by any means such as a continuous belt or by manual means. As the tube rotates, the bundles are retained by projections 24 and carried up the slope of the interior walls of the tube 11 and are dropped downwardly until they separate into individual units. The individual units either slide down between the projections and out the lower opening of the tube or are carried up the axis of the tube by the forced air.

It should be understood that there are many operating variables in the above described apparatus and method. Based on the type of paper being sorted, the variables can be selected to produce optimum sorting conditions. The variables include the slope of the incline of the tube which can be varied by pivoting tube 11 around pivot point 15; the speed at which the tube rotates which can be controlled by any mechanical means; the direction in which it rotates (clockwise or counterclockwise); the velocity of the air stream produced by the fan; the angle of inclination of the airstream with respect to the axis of the tube; the spacing, shape and length of protrusions 24; and the pattern of the projections on the interior walls of the cylindrical tube 11. The sorter 10 is particularly useful in that in the first cycle, newspaper and other very light materials can be sorted from magazines, cardboard and refuse by choosing a set of variables suited to optimum sorting conditions. After this portion of the sorting is completed, another set of variables can be selected and the material at the bottom of the tube can be re-entered at the top of the tube and sorted again. This process can continue until all desired sorting is completed.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An apparatus for sorting materials having various weights and aerodynamic characteristics comprising:

a tubular member having a generally cylindrical shape, said tubular member having a first material receiving end and a second end, said tubular member further having an interior wall and an axis;

a plurality of spacially displaced spikes extending into said tubular member from the interior wall thereof, said spikes being arranged in a helical pattern;

means for rotating said tubular member about its axis;

support means for said tubular member, said support means including means for varying the angle of the axis of said tubular member with respect to the horizontal, the first end of said tubular member normally being elevated with respect to the second end of said tubular member; and a fan positioned adjacent to the second end of said tubular member, said fan forcing air into said tubular angle at an angle with respect to the axis thereof whereby a stream of air will flow upwardly through the tubular member in a spiral pattern.

2. An apparatus according to claim 1 and further including means for adjusting the direction of the fan with respect to the axis of the tube.

* * * * *